United States Patent [19]

Gundlach et al.

[11] 4,197,331

[45] Apr. 8, 1980

[54] NOVEL ELECTROSTATIC IMAGING SYSTEM

[75] Inventors: Robert W. Gundlach, Victor; Richard F. Bergen, Ontario, both of N.Y.

[73] Assignee: Xerox Corporation, Stamford, Conn.

[21] Appl. No.: 969,591

[22] Filed: Dec. 14, 1978

[51] Int. Cl.[2] ..... G03G 13/00; G03G 13/06

[52] U.S. Cl. ..... 430/126; 101/DIG. 13; 430/107; 430/124

[58] Field of Search ..... 427/13, 14, 19; 96/1 C, 96/1.4; 101/DIG. 13

[56] References Cited

U.S. PATENT DOCUMENTS

| | | | |
|---|---|---|---|
| 3,145,655 | 8/1964 | Hope et al. | 101/DIG. 13 |
| 3,306,198 | 2/1967 | Rarey | 101/DIG. 13 |
| 3,326,709 | 6/1967 | Nail | 101/DIG. 13 |
| 3,483,027 | 12/1969 | Ritzerfeld et al. | 101/DIG. 13 |
| 3,585,061 | 6/1971 | Allinger et al. | 427/19 |
| 3,770,484 | 11/1973 | Shreeve | 427/19 |
| 3,928,669 | 12/1975 | Takahashi | 427/19 |

*Primary Examiner*—Ronald H. Smith
*Assistant Examiner*—Stuart D. Frenkel

[57] ABSTRACT

An electrostatic imaging system in which a conductive pattern and triboelectric charging are utilized on opposite sides of an electrically insulating member to form a developable electrostatic latent image. Electrostatically charged marking particles are deposited in conformance to the latent image and thereafter transferred to a receiving sheet. Charging, development and transfer are effected without the aid of light or any externally applied voltage.

14 Claims, 5 Drawing Figures

NOVEL ELECTROSTATIC IMAGING SYSTEM

The foregoing abstract is neither intended to define the invention disclosed in the specification, nor is it intended to be limiting as to the scope of the invention in any way.

BACKGROUND OF THE INVENTION AND PRIOR ART STATEMENT

This invention relates in general to imaging systems, and more particularly, to improved toner image forming and transfer devices and methods.

The formation and development of images on the surface of photoconductive materials by electrostatic means is well-known. The basic xerographic process, as taught by C. F. Carlson in U.S. Pat. No. 2,297,691, involves placing a uniform electrostatic charge on a photoconductive insulating layer, exposing the layer to a light and shadow image to dissipate the charge on the areas of the layer exposed to the light and developing the resulting electrostatic latent image by depositing on the image a finely-divided electroscopic marking material referred to in the art as "toner". The toner will normally be attracted to those areas of the layer which retain a charge, thereby forming a toner image corresponding to the electrostatic latent image. The toner image may be transferred to a receiving member such as paper. The transferred toner image may be permanently affixed to a support surface as by heat.

In U.S. Pat. No. 2,297,691, charging is effected, for example, by vigorously rubbing with a soft material such as cotton or silk handkerchief the surface of a photoconductive insulating layer supported on a conductive substrate. The layer is rubbed in the dark so that it will be at its highest insulating value and hence will retain the charge uniformly distributed on its surface. The conductive backing member is normally grounded so that a high potential difference will exist between the charged surface of the photoconductive insulating layer and the conductive substrate. The photoconductive insulating layer is then immediately exposed to a light image or pattern to be reproduced to form a charge pattern on the layer. The exposed layer is thereafter contacted in the dark with toner particles having an electrostatic charge polarity opposite the polarity of the charge on the surface of the photoconductive insulating layer to deposit the toner particles in conformance with the charge pattern on the photoconductive insulating layer. Transfer to paper, metal foil or other sheet material is effected by carefully laying the sheet material on the deposited image and firmly pressing against the surface with a block carrying a felt or sponge rubber pad. This will transfer a part of the power to the surface of the sheet material making the image visible thereon. In order to improve transfer an adhesive is applied to the receiving sheet prior to contact with the deposited toner image. Plain water or other liquids are often satisfactory, especially with paper sheets. Wax parafin or other soft or sticky substances also may be used.

The charging technique disclosed by Carlson achieved voltages which were much too low for practical xerography. Indeed, it is surprising that he was able to demonstrate the phenomena at all, particularly since electrostatic voltages obtained directly by frictional electrification are not only low but unreliable. Electrophotography has progressed dramatically since the filing of U.S. Pat. No. 2,297,691. In most modern lectrophotographic copying and duplicating devices of today, charging of the electrophotoconductive insulating layer and transfer of the deposited toner image are effected with high voltage corona charging devices which operate at potentials of from about 2,000 to about 8,000 volts. Expensive and bulky power supply equipment is required to supply these high potentials to the corona charging devices.

Electrostatic recording systems have also been developed which do not require a light pattern exposure system or a photoreceptor. For example, the apparatus and methods described by Frederick A. Schwertz in U.S. Pat. No. 2,978,968 involve electrically forming latent images on a web by positioning the web between a shaped electrode and a reference electrode, forming an electric field between the shaped electrode and the reference electrode to just below the threshold potential at which discharge can begin, and thereafter raising the potential of the reference electrode above the threshold so that discharge takes place from the shaped electrode to deposit electronic or ionic charges on the surface of the web to form an electrostatic latent image. Generally, the potentials applied to the reference electrode above the threshold are at least several hundred volts and usually between about 700 and about 2,000 volts. In another embodiment in U.S. Pat. No. 2,978,968, the web is precharged by exposure to a corona charging electrode energized at a potential of several thousand volts, generally about 6,000 to 10,000 volts. Similar devices and techniques are disclosed by Frederick A. Schwertz in U.S. Pat. Nos. 3,023,731; 3,064,259 and 3,068,481.

Similarly, Robert W. Gundlach describes in U.S. Pat. No. 3,004,860 various known techniques for forming toner images on imaging members which do not require a light pattern exposure system or a photoreceptor. Gundlach also discloses in the same patent a transfer technique in which a toner image on an insulating layer backed by a conductive backing is transferred to a conductive sheet placed on the toner image, the conductive sheet being electrically connected to some point at a potential substantially that of the conductive backing. The point can be the conductive backing itself. However, the toner image and insulating layer must be corona charged prior to contact with the conductive sheet.

While ordinarily capable of producing good quality images, conventional developing apparatus and processes suffer deficiencies in certain areas. Expensive, complex and potentially hazardous corona charging devices in high voltage power supplies are usually necessary to form an electrostatic latent image and/or transfer a toner image. Moreover, conventional electrostatic transfer systems tend to transfer toner particles deposited in background areas of a photoreceptor. Triboelectric charging of a photoreceptor coupled with exposure to a light pattern often produces unreliable results. Reusable photoreceptors and/or the equipment necessary to transport them in conventional electrophotographic copiers and duplicators are expensive to manufacture or occupy valuable machine space. The material and physical property limitations of conventional photoconductors adversely constrain choice of materials and machine design. The optical system in most commercial electrophotographic devices are complex, bulky, fragile, and expensive to manufacture. Thus, there is a continuing need for a better system for forming electrostatic latent images, developing the electrostatic latent image and transferring the resulting toner image.

Accordingly, it is a primary object of the present invention to improve electrostatic imaging systems in which electrostatic latent images, charged toner particles and electrostatic transfer are utilized.

SUMMARY OF THE INVENTION

Briefly stated, and in accordance with the present invention, there is provided an apparatus and process for forming an electrostatic latent image, depositing toner particles in conformance with the electrostatic latent image and transferring the resulting toner image.

Pursuant to the features of the invention, an insulating member having an imaging surface on one side and a non-imaging surface on the opposite side is contacted on the non-imaging surface with an electrically grounded conductive pattern; triboelectrically charged to a first polarity on the imaging surface to induce an electrostatic charge having a polarity opposite to said first polarity in the conductive pattern at the interface of the conductive pattern with the non-imaging surface; and developed on the imaging surface with toner particles having an electrostatic charge of the same polarity as said first polarity to deposit a toner image conforming to the pattern. Transfer of the toner image is effected by contacting the toner image with an electrically grounded conductive or semiconductive receiving member.

BRIEF DESCRIPTION OF THE DRAWINGS

Other objects and advantages of the present invention will become apparent upon reading the following detailed description and upon reference to the drawings, in which.

While the present invention will hereinafter be described in connection with preferred embodiments thereof, it will be understood that it is not intended to limit the invention to these embodiments. On the contrary, it is intended to encompass all alternatives, modifications and equivalents as may be included within the spirit and scope of the invention as defined by the appended claims.

DETAILED DESCRIPTION OF THE INVENTION

Figure 1:
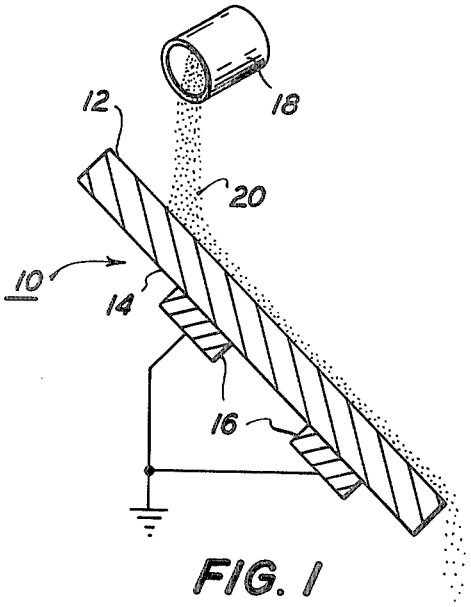
FIG. 1 is a schematic elevational view depicting an electrostatic imaging system incorporating the charging and developing features of the present invention therein.

For a general understanding of the illustrative electrostatic imaging system incorporating the features of the present invention therein, reference is made to the drawings. In the drawings, like reference numbers have been used throughout to designate identical elements. Referring now to FIG. 1, reference character 10 designates an electrically insulating imaging member such as polyethyleneterephalate (Mylar) having an imaging surface 12 and a non-imaging surface 14. Electrically grounded shaped electrodes 16 are positioned against the non-imaging surface 14. A supply reservoir 18 containing a supply of two component developer 20 of a conventional triboelectrically chargeable mixture of carrier particles and toner particles is positioned above the upper end of imaging surface 12 to provide a stream of the two component developer to the imaging surface 12. Obviously, other well-known devices may be substituted in place of the reservoir 18 such as conventional bucket conveyor or low conductivity magnetic brush apparatus. As is well-known in the art, two component developer materials normally comprise toner particles having an electrotatic charge of one polarity electrostatically clinging to the surface of larger carrier particles having an electrostatic charge of a polarity opposite to the polarity of the toner charge. The triboelectric relationship between the carrier material and the imaging surface 12 is selected so that as the carrier material bounces and tumbles along imaging surface 12, the carrier particles triboelectrically charge the imaging surface with a charge of the same polarity as that of the toner particles.

Figure 2:
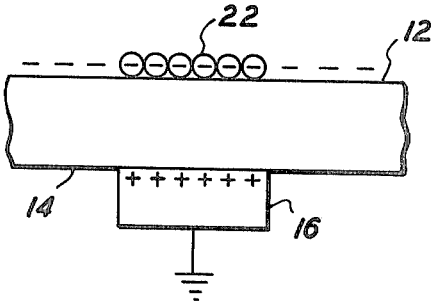
FIG. 2 is a fragmentary enlarged elevational view of a developed electrostatic latent image formed with the FIG. 1 imaging system.

In FIG. 2, an expanded view of a portion of the apparatus of FIG. 1 is shown. For purposes of illustration only, triboelectric charging of the imaging surface 12 by the carrier particles from the two component developer 20 are shown as having a negative polarity. Obviously, if one preferred, one could employ carrier particles which would deposit a positive charge on imaging surface 12 and all the other charges shown in the figure could also be reversed in polarity without detracting from the effectiveness of the imaging technique. When the negative charge shown in FIG. 2 is deposited on imaging surface 12, an opposite charge is induced in shaped electrode 16 at the interface between shaped electrode 16 and non-imaging surface 14. Since the toner particles 22 have been charged to a negative polarity, they are repelled from the portions of the imaging surface 12 that are not opposite the shaped electrode 16. However, the toner particles 22 are attracted to and deposit on those portions of the imaging surface 12 that are opposite the shaped electrode 16. It is hypothesized that toner particles respond to fields generated between the triboelectrically charged imaging surface 12 and the low potential conductive shaped electrode 16.

Figure 3:
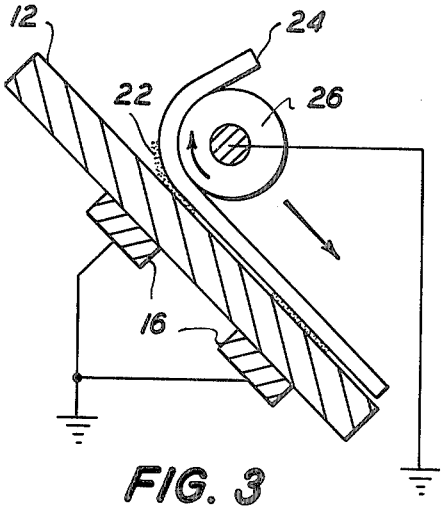
FIG. 3 is a schematic elevational view depicting electrostatic transfer of the toner image formed with the system in FIG. 1.

In FIG. 3, the toner particles 22 that have been deposited on imaging surface 12 are transferred to a conductive or semiconductive receiving member 24, such as paper, with the aid of a grounded electrically conductive transfer roller 26. Electrical grounding of the shaped electrodes and transfer roller is maintained during the transfer step.

Figure 4:
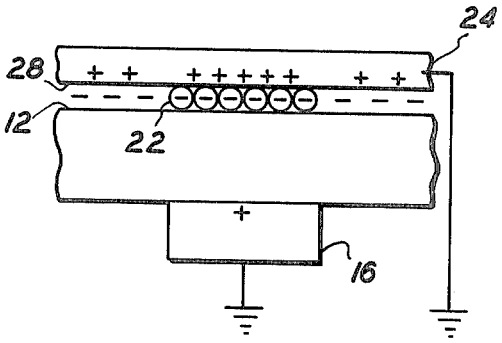
FIG. 4 is a fragmentary enlarged elevational view diagrammatically illustrating the distribution of charges during the transfer effected with the system of FIG. 3.

FIG. 4 illustrates the relative locations of the electrical charges during the transfer step down in FIG. 3. Since the shaped electrode 16 and receiving member 24 are both electrically connected to ground, and since receiving surface 28 of receiving member 24 is physically located closer to toner particles 22 than shaped electrode 16, the toner particles 22 are more strongly attracted to the positive charges in receiving member 24 than to shaped electrode 16.

Figure 5:
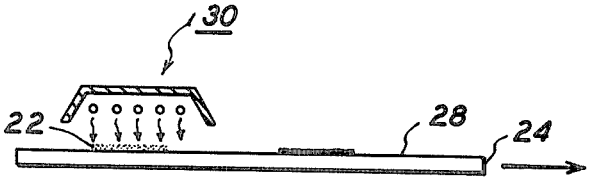
FIG. 5 is a schematic elevational view depicting fixing of the transferred toner image obtained with the system shown in FIG. 3.

Referring now to FIG. 5, the receiving member 24 after separation from imaging surface 12 is transported by a conveyor belt (not shown) beneath a conventional fuser 30 to fuse the toner particles 22 to the receiving surface 28 of receiving member 24.

It is apparent that throughout the entire imaging operation, no corona devices or a high voltage power supply are necessary. Thus, the cost, space requirements, and potential shock hazards are minimized or eliminated. Moreover, elimination of the requirement for a photoreceptor provides significant flexibility of choice of materials. Further, no expensive, sophisticated space-consuming optical system is necessary for the imaging system of this invention. The entire operation may be contained in a highly compact, portable printing machine which can be operated, if desired, with no external source of electricity in remote locations such as one-room jungle schoolhouse. The imaging system of this invention could also be used in xeroprinting, envelope addressing and many other imaging devices.

The imaging member used in connection with this invention may be selected from any suitable insulating material of any suitable shape such as a web, a sheet, film, plate, belt or cylinder, having a resistivity at least about $10^{13}$ ohm-cm. An imaging member resistivity of about $10^{13}$ ohm-cm permits retention of an electrostatic charge on the imaging surface for a reasonable length of time so that both development and transfer can be accomplished. For improved transfer of the toner image, particularly at slower speeds, the imaging member should preferably have a resistivity equal to or greater than about $10^{14}$ ohm-cm. Satisfactory images are obtained with imaging members having a thickness less than about 8 mils. The thickness selected depends upon the size of the images to be formed. For example, block printing and poster type images may be obtained with an imaging member thickness of about 6 mils. However, a thickness of about 1.5 to 3 mils is preferred for typewriter images. Although very thin imaging members may be employed in this invention, extremely thin materials are physically difficult to manipulate. Thus, generally speaking, an imaging member having a thickness between about 1.5 to about 6 mils is preferred. Optimum images are obtained with an imaging member a thickness of between about 2 mils to about 5 mils.

Any suitable insulating material may be employed in the imaging member. Typical insulating materials include polyethylenes, polypropylenes, polyurethanes, polycarbonates, polytetrafluoroethylene (e.g. Teflon), polyvinyl chloride, polyvinylidene chloride (e.g. Saran), polyethylene terephthalate (e.g. Mylar), polyacrylic resins, acetate films, dry paper, paper impregnated with insulating resins and the like. In selecting the specific material to be used in the insulating member, one should select a material which will permit a charge to be built up on the imaging surface of the imaging member having a charge polarity of the same sign as the charge polarity of the toner to be used.

Any suitable conductive material may be employed in the shaped electrode of this invention. Generally speaking, the electrode material should be sufficiently conductive to maintain an essentially zero electric potential in the conducting image areas even while electric charges are being triboelectrically deposited on the imaging surface of the imaging member. In other words, the shaped electrode should be sufficiently conductive within the developing time to induce an electrostatic image from ground sufficient to retain toner particles. It should be understood that any fixed potential, preferably a low potential, can be applied to the shaped electrode. Generally, satisfactory toner images are obtained with conductive electrode materials having a surface resistivity less than about $10^7$ ohms/square. Electrode surface resistivities of $10^5$ ohms/square are preferred for greater development rates. It will be recognized that the minimum conductivity or maximum resistivity of the shaped electrode will depend both on the geometry of the electrode and the development rate, since the basic requirement is to supply charge at a rate sufficient to maintain the applied voltage as the image develops on the opposite surface.

Normally, the portion of the shaped electrode corresponding to the desired image and facing the non-imaging surface of the imaging member should be in contact with the imaging member. Pressure contact is desirable and can be achieved by any suitable technique, for example, by vacuum means which sucks the imaging member against the shaped electrodes or by stretching an imaging sheet or web over the convex surface of a grounded metal letterpress plate having relief characters. In order to minimize toner deposition in the background areas, care should be taken to space any conductive material from the regions of the non-imaging surface that correspond to the background areas on the imaging surface unless the width of the conductive material in contact with the background areas of the non-imaging surface is less than about one-fifth the thickness of the imaging member. For example, satisfactory results are achieved where the supporting metal material between raised letters on a letterpress plate are recessed about 20 mils or more from the top surfaces of the raised letters. A distance of at least about 30 mils between any conductive material having an image width greater than about 5 times the thickness of the imaging member and the portions of the non-imaging surface corresponding to the background areas is preferred for reducing toner deposits in the background areas of the imaging surface. Optimum results are achieved when the conductive material to non-imaging surface distance is greater than about 40 mils in the background regions.

The surface of the shaped electrodes in contact with the non-imaging surface of the imaging member may be of any suitable configuration such as flat, convex or concave. Moreover, the shaped electrode may be rigid or flexible and comprise any suitable electrically conductive organic or inorganic material. Typical electrically conductive materials include gold, lead, copper, silver, iron, steel, nickel, graphite, Aquadag, aluminum and the like. Conductive materials such as grease pencil coloring (e.g., The Blaisdell China-Marker 169-T (red) and 164-T (black); No. 2 pencil lead; the adhesive of "Scotch" Brand Permanent Mending Tape #6200; conductive paint; and liquid soap have been found to be sufficiently conductive to attract toner particles to the imaging surface of the imaging member. Electrical grounding may be effected by connecting the shaped electrodes to a source that adds negligible impedance. For example, sufficient grounding is effected when the electrode is in contact with a human body. The principal objective of grounding is to maintain an essentially zero potential throughout the shaped electrode while the electrical charges are being triboelectrically deposited on the imaging surface of the imaging member. The shaped electrode can be considered a low potential electrode wherein the potential is low enough so that fields between the electrode with the rest of the universe are negligible compared with the developable fields generated. Physical connection of the shaped electrodes to ground may be accomplished by any suitable technique such as by conductive wires, brushes, fine grid patterns printed on the non-imaging surface, and the like. Also, periodic contact to ground, such as by a fur brush with a low percentage of thin flexible metallic fibers may be used. If the individual shaped electrodes are part of a metal letterpress plate, only a single connection to ground is necessary. Grounding may even be effected by pressing ones finger against the shaped electrode. Where transfer of the deposited toner image is contemplated, the shaped conductor should be maintained in contact with the non-imaging surface of the imaging member until transfer is effected to prevent explosion of the deposited toner particles from the imaging surface.

The developers employed to form the toner images of this invention may be of a single component or multicomponent type. Any suitable pigmented or dyed electroscopic toner material having a resistivity of at least about $10^{13}$ ohm-cm may be employed to form the toner images of this invention provided that the electrostatic charge polarity of the toner is of the same polarity as the polarity of the background areas of the imaging surface. Typical toner materials include: gum copal, gum sandarac, rosin, cumaroneindene resin, asphaltum, gilsonite, phenol-formaldehyde resins, rosin-modified phenol-formaldehyde resins, methacrylic resins, polystyrene resins, polypropylene resins, epoxy resins, polyethylene resins and mixtures thereof. Among the many patents describing electroscopic toner compositions are U.S. Pat. No. 2,659,670 to Copley; U.S. Pat. No. 2,753,308 to Landrigan; U.S. Pat. No. 3,079,342 to Insalaco; U.S. Pat. No. Re. 25,136 to Carlson; U.S. Pat. No. 2,788,288 to Rheinfrank et al and U.S. Pat. No. 3,590,000 to Palermiti et al. These toners generally have an average particle diameter between about 1 and about 30 microns.

When carrier particles are employed in the developers used to form the toner images of this invention, the carrier particles should be selected of materials which will triboelectrically charge the imaging surface to a polarity opposite to the polarity of charge on the carrier. Any suitable well-known coated or uncoated electrostatographic carrier bead material may be employed in the developers used in this invention. Typical carrier materials include granular zircon, granular silicon, flintshot, glass, silicon dioxide, methylmethacrylate, ethyl cellulose, chlorotrifluoroethylene resin, and the like. The carriers may be employed with or without a coating. Many of the foregoing and typical carriers are described by L. E. Walkup in U.S. Pat. No. 2,618,551; L. E. Walkup et al in U.S. Pat. No. 2,638,416; E. M. Wise in U.S. Pat. No. 2,618,552 and Hagenbach et al in U.S. Pat. No. 3,533,835. Generally, satisfactory results are achieved with toner particles having an average particle size of between about 100 microns and about 1000 microns. For cascade development, carrier particle sizes between about 250 microns and about 700 microns are preferred to prevent adherence of the carrier particles to the imaging surface. Coated and uncoated carrier materials for cascade and magnetic brush development are well-known in the art. The carrier particles may be electrically conductive, insulating, magnetic or non-magnetic, provided that the carrier particles acquire a charge having an opposite polarity to that of the toner particles and to that of the imaging surface when brought in close contact with either the toner particles or the imaging surface. Generally, the carrier particle material is selected so that the toner particles acquire a charge having a polarity opposite to that of the induced charges in the shaped electrodes. Thus, the materials for the carrier particles are selected in accordance with its triboelectric properties in respect to the material of the electroscopic toner and imaging surface so that when mixed or brought into mutual contact, the carrier is charged positively and the toner and imaging surface are charged negatively if the toner and imaging surface materials are below the carrier in the triboelectric series and negatively if the toner and imaging surface materials are above the carrier material in the triboelectric series. By proper selection of materials in accordance with their triboelectric effects, the polarity of charge when mixed or contacted are such that the electroscopic toner particles adhere to and are coated on the surfaces of carrier particles and also adhere to that portion of the electrostatic latent image of the imaging surface having a greater attraction for the toner than the carrier particles.

Where developers free of carrier materials are employed to develop the electrostatic latent image of this invention, charging of the imaging surface is normally effected prior to deposition of the toner particles. The deposited charge on the imaging surface should have a polarity of charge of the same sign as that of the toner particles. Moreover, the charge should be deposited triboelectrically rather than by, for example, corona discharge. When the corona charging is attempted, an equipotential phenomenon is observed and no voltage difference sufficient to effect development is achieved. Triboelectric charging prior to deposition of toner particles may be accomplished by known techniques such as contact with carrier beads, a fiber brush, a liquid or the like. Normally, where the imaging surface is triboelectrically charged prior to development with toner, the charging material should be sufficiently insulating to prevent bleeding, dissipating or discharge of the surface charge on the imaging surface during the development period. Generally, satisfactory results may be achieved with triboelectric charging material having a resistivity greater than about $10^{12}$ ohm-cm. A triboelectric charging material resistivity of $10^{13}$ ohm-cm is preferred to achieve more rapid charging. Where the imaging surface is triboelectrically charged prior to deposition of toner particles, one may employ suitable conventional development techniques such as powder cloud development, liquid development, touchdown development as taught by R. W. Gundlach in U.S. Pat. No. 3,166,432 or the like to apply toner particles to the electrostatic latent image.

When developers containing toner particles and carrier particles are employed, one may transport the developer to the imaging surface by numerous different techniques. When conventional cascade techniques are used, preferred results are achieved when the developer is allowed to free fall from about 6 to about 10 inches onto the imaging surface. The free fall apparently causes at least some of the toner particles to be dislodged from the carrier particles and promotes formation of images having greater density. Obviously, the effect of freely falling developer can be simulated by other suitable techniques such as mechanical acceleration, e.g., use of developer transport paddle wheels as illustrated in U.S. Pat. No. 4,033,293 to Ohmori et al. Other techniques for development which utilize a carrier or a substitute for a carrier include magnetic brush development as taught by H. G. Greig in U.S. Pat. No.

2,874,063; fluidized bed development as taught by G. R. Mott et al in U.S. Pat. No. 3,008,826; fur brush development as taught by Greaves in U.S. Pat. No. 2,902,974; immersion development as taught by R. W. Gundlach in U.S. Pat. No. 3,503,776.

Generally, the toner when used alone or the combination of toner and carrier should be sufficiently insulating to prevent bleeding, dissipation or discharge of the electrostatic surface charge on the imaging surface during the time period required for development, which is normally at least about 0.10 second.

The receiving member may be selected from any suitable electrically conductive or semiconductive material having an electrical relaxation time that is shorter than the time required to effect transfer. In other words, the receiving member should be sufficiently conductive to induce charges on or near the surface of the receiving member adjacent the toner particles during the period of transfer. Although toner images may be transferred to receiving members having a resistivity as high as $10^8$ ohm-cm, lower resistivity is desirable for higher transfer rates. The receiving member may be of any suitable shape such as a sheet, web, film, cylinder, belt or the like. Typical electrically conductive or semiconductive materials include paper, cardboard, cotton cloth, metal, materials coated or impregnated with conductive substances such as Aquadag, wetting agents, metal particles and the like. The receiving member should be electrically grounded during transfer to permit the formation of sufficient induced charges at the interface between the toner image to be transferred and the receiving surface of the receiving member to form an attractive force toward the receiving surface which is greater than the attractive force of the charges in the more remote shaped electrodes.

Any suitable means may be utilized for electrically grounding the receiving member. Typical means for electrically grounding the receiving member include conductive rollers, conductive plates, conductive coatings on the receiving member, conductive brushes, conductive stylii, a human hand, AC corona charging and the like.

When thin shaped electrodes are employed, e.g., metal foil, on flexible imaging members and a rigid backing is necessary to support the imaging member during transfer, care should be taken to insure that any conductive component of the rigid support is sufficiently spaced from the non-limiting surface of the imaging member so that transfer of the toner image is not adversely affected. In other words, it is highly desirable that the portion of the rigid support member in contact or close proximity with the imaging member be insulating to reduce transfer of the background toner. However, as indicated previously, each of the shaped electrodes should be electrically grounded during transfer of the toner image from the imaging surface to the receiving surface.

The imaging member may be reused after a deposited toner image is transferred. The electrostatic latent image formed during the previous imaging steps can be developed again with development techniques such as powder cloud development. It is believed that discharge of the electrostatic latent image does not occur because molecule to molecule contact does not occur.

When developers containing carrier particles are brought into rubbing contact with the imaging surface for extended periods of time, electric charges tend to build up to a level where Lichtenberg charge patterns are formed on the non-imaging surface of the imaging member radiating outward from the shaped electrodes. The shape of the Lichtenberg charge patterns depend upon the polarity of charge triboelectrically deposited on the background areas of the imaging surface. More specifically, the shape of developed Lichtenberg charge patterns resemble tree branches when the polarity of the charge deposited in the background areas of the imaging surface is negative. If the triboelectric relationship between the toner, carrier and imaging surface is selected so that the background areas of the imaging surface are triboelectrically charged to a positive polarity, the Lichtenberg charge patterns resemble fish scales when the imaging surface is developed with positively charged toner particles. Although toner particles deposit in conformance to the Lichtenberg charge patterns, those deposited toner particles do not transfer to the receiving surface of the receiving member when the deposited toner particles corresponding to the pattern of the shaped electrodes transfer to the receiving surface during the transfer process. Thus, although the Lichtenberg charge patterns are an interesting phenomenon, they do not adversely affect the appearance of the transferred toner image corresponding to the pattern of the shaped electrodes.

After transfer of the toner image, the imaging surface may be cleaned by any suitable technique including conventional fur brush, blade, of fibrous web cleaning systems. However, cleaning is normally not necessary.

The toner image, whether on the imaging surface or receiving surface, can be fixed by conventional techniques. For example, depending upon the toner materials employed, fixing may be accomplished by well-known processes such as heat, solvent, pressure, laminating, and the like.

It is clearly apparent that development and transfer may be effected without any externally applied voltage. Although external voltages may be applied to the shaped electrode or receiving member of this invention, such externally applied voltage is unnecessary to effect deposition or transfer of the toner particles.

The following examples further specifically define and describe the system of the present invention for forming and developing electrostatic latent images and transferring the resulting developed image without the aid of a high voltage power source or photoreceptor.

EXAMPLE I

An electrically conducting gridwork of No. 1 pencil lead is applied to the non-imaging side of an electrically insulating sheet of polyvinyl chloride having a resistivity of about $10^{15}$ ohm-cm and a thickness of about 6 mils. The message "10-22-38" Astoria is then written over the gridwork with No. 1 pencil lead. The sheet is positioned at about a 45° angle to horizontal with the gridwork and message facing downwards. A developer comprising about 99 parts by weight glass carrier beads coated with a silicone terpolymer reaction product of butylmethacrylate, styrene and vinyl triethoxysiliane and having an average diameter of about 450 microns and about 1 parts by weight toner particles comprising a copolymer of styrene and butylmethacrylate pigmented with carbon black and having an average particle size of about 12 microns and resistivity of about $10^{15}$ ohm-cm is poured from a height of about 8 inches onto the uppermost end of the upward facing side of the sheet. The gridwork is electrically grounded during the entire development and subsequent transfer process by contact with the left hand of the operator of the imaging process. As the developer tumbles down the inclined upper surface of the sheet, toner particles deposit on the upper imaging surface to form a visible image corresponding to the gridwork and message on the lower surface of the sheet. The carrier in this example is triboelectrically charged to a positive polarity and the toner and non-image areas of the insulating sheet are triboelectrically charged to a negative polarity. As the pouring of the developer is continued after the visible toner image is formed, developed Lichtenburg figures resembling tree branches or lightning bolts form and appear to radiate outwardly from the visible message. Development is then discontinued and the developer sheet is placed image side up on a table having an insulating Formica surface. However, one end of the sheet extends from the edge of the table to permit connection of the gridwork to ground to be maintained. A sheet of ordinary bond paper having a resistivity of about $10^9$ ohm-cm is then placed over and in contact with the toner image. The operator then gently and firmly rubs his right hand against the exposed upper surface of the bond paper while maintaining contact between his left hand and the gridwork. Good quality toner images of the gridwork and message substantially free of background toner deposits are observed on the bond paper after the bond paper is removed from the electrically insulating sheet. No transfer of the developed Lichtenburg figures is observed. The transferred toner image is then fused to the bond paper by placing the imaged bond paper in an oven preheated to 250° F. The quality of the images remained unchanged after fusing.

EXAMPLE II

The process of Example I is repeated without grounding of the conductive grid pattern and message. No toner deposits corresponding to the grid pattern and message are observed when the developer is poured over the insulating sheet. This demonstrates that charge will not be induced in the conductive grid pattern or message unless it is grounded.

EXAMPLE III

The process of Example I is repeated except that the insulating sheet rests on a conductive metal support instead of the Formica support during the transfer step. Most of the deposited toner image including and Lichtenburg figures is observed to transfer to the bond paper. This demonstrates that transfer can only occur from areas opposite a grounded surface.

EXAMPLE IV

The process of Example I is repeated except that electrically conductive red grease pencil coloring material (The Blaisdell China—Marker 169-T) is substituted for the No. 1 pencil lead of Example I. Substantially identical results are observed.

EXAMPLE V

A Kodak Photo Resist (KPR) photoresist coating is applied in the dark to a copper layer having a thickness of about 0.4 mil on a polyethyleneterephthalate support having a resisitivity of about $10^{16}$ ohm-cm and a thickness of about 4 mils. The photoresist is photographically exposed to form a hardened exposed pattern on the photoresist having grid lines of about 0.4 mil wide and letters of about 15 mils wide intersecting with the grid lines. The unexposed portions of the photoresist are removed by rubbing with cotton containing a solvent for the photoresist. The copper underlying the removed portions of the photoresist coating are removed by contact with a solution of ferric chloride. The resulting imaging member and etched copper electrode pattern is charged and developed as described in Example I. The toner particles are deposited on the imaging member in the areas of the upper surface of the imaging member corresponding to the copper letters but are not deposited in the areas corresponding to the copper gridwork.

EXAMPLE VI

A film of polyethylene terephthalate (Mylar) having a resistivity of about $10^{16}$ ohm-cm and a thickness of about 3 mils is stretched over an electrically conductive metal letterpress plate having character relief of about 35 mils. The letterpress plate is grounded during the entire and transfer process. The developer of Example I is poured over the exposed surface of the film and a toner image corresponding to the characters of the letterpress plate is formed. The carrier in this example is triboelectrically charged to a positive polarity and the toner and non-image areas of the film are triboelectrically charged to a negative polarity. A sheet of bond paper substantially identical to the paper described in Example I is placed over the imaged film and a grounded electrically conductive roller is rolled across the exposed side of the paper. The paper is removed from the film and the toner image is made permanent by laminating a transparent sheet to the film. Good quality toner images corresponding to the characters on the letterpress plate and substantially free of background toner deposits are observed on the laminated film.

EXAMPLE VII

The procedure described in Example I is repeated except that an electrically insulating sheet of a copolymer of butylmethacrylate and styrene having a resistivity of about $10^{15}$ ohm-cm and a thickness of about 5 mils and a developer comprising flintshot carrier particles coated with polyvinyl chloride and having an average particle size of about 600 microns and toner particles comprising a copolymer of 2,2 bis(4-hydroxy-isopropoxyphenyl)-propane and fumeric acid and having an average particle size of about 10 microns and a resistivity of about $10^{15}$ ohm-cm are substituted for the insulating sheet and developer of Example I. Unlike Example I, the carrier particles of this example are triboelectrically charged to a negative polarity and the toner particles and insulating sheet are triboelectrically charged to a positive polarity. Good quality toner images corresponding to the gridwork and message and substantially free of background toner deposits are obtained on the bond paper after transfer and fusing.

It will be appreciated that other variations and modifications will appear to those skilled in the art upon a reading of the present disclosure. These are intended to be within the scope of the invention.

What is claimed is:

1. An electrostatic imaging process comprising providing an imaging member having an imaging surface on one side and a non-imaging surface on the opposite side, contacting said non-imaging surface with an electrically grounded conductive pattern, triboelectrically charging said imaging surface to a first polarity to induce an electrostatic charge having a polarity opposite said first polarity in said conductive pattern at the interface of said conductive pattern with said non-imaging surface, and contacting said imaging surface with toner particles having an electrostatic charge of the same polarity as said first polarity to deposit on said imaging surface a deposited toner image conforming to said pattern.

2. An electrostatic imaging process according to claim 1 including the step of placing an electrically grounded conductive or semiconductive receiving member in contact with said deposited toner image and separating said receiving member from said imaging surface whereby said deposited toner image is transferred to said receiving member.

3. An electrostatic imaging process according to claim 2 wherein said receiving member has a resistivity less than about $10^8$ ohm-cm.

4. An electrostatic imaging process according to claim 1 including simultaneously triboelectrically charging said imaging surface and contacting said imaging surface with said toner particles.

5. An electrostatic imaging process according to claim 1 wherein said imaging member has a resistivity of at least about $10^{13}$ ohm-cm.

6. An electrostatic imaging process according to claim 1 wherein said imaging member has a resistivity of at least about $10^{14}$ ohm-cm.

7. An electrostatic imaging process according to claim 1 wherein said imaging member has a thickness less than about 8 mils.

8. An electrostatic imaging process according to claim 1 wherein said imaging member has a thickness from about 1.5 mils to about 3 mils.

9. An electrostatic imaging process according to claim 1 wherein said condutive pattern has a surface resistivity less than about $10^7$ ohms/square.

10. An electrostatic imaging process according to claim 1 wherein said conductive pattern has a surface resistivity less than about $10^5$ ohms/square.

11. An electrostatic imaging process according to claim 1 including providing a conductive pattern comprising separate multiple electrode elements and providing electrical connections between said elements.

12. An electrostatic imaging process according to claim 11 including maintaining said electrical connections from said non-imaging surface by a distance of at least about 20 mils.

13. An electrostatic imaging process according to claim 11 including maintaining said electrical connections from said non-imaging surface by a distance of at least about 30 mils.

14. An electrostatic imaging process according to claim 11 wherein said electrical connections have a width less than about one-fifth the thickness of the imaging member.

* * * * *